United States Patent [19]

Sheasby et al.

[11] 4,310,586

[45] Jan. 12, 1982

[54] ALUMINIUM ARTICLES HAVING ANODIC OXIDE COATINGS AND METHODS OF COLORING THEM BY MEANS OF OPTICAL INTERFERENCE EFFECTS

[75] Inventors: Peter G. Sheasby, Bloxham; Graham Cheetham, Deddington, both of England; Rainer W. M. Stuckart, Achim, Fed. Rep. of Germany; Tarun K. S. Gupta, Maharahstra, India

[73] Assignee: Alcan Research and Development Limited, Montreal, Canada

[21] Appl. No.: 140,447

[22] Filed: Apr. 17, 1980

Related U.S. Application Data

[63] Continuation of Ser. No. 3,891, Jan. 16, 1979, abandoned.

[30] Foreign Application Priority Data

Jan. 17, 1978 [GB] United Kingdom ..... 1875/78

[51] Int. Cl.[3] ..... C25D 11/12; C25D 11/22

[52] U.S. Cl. ..... 428/220; 204/35 N; 204/42; 204/58; 428/336; 428/469

[58] Field of Search ..... 204/35 N, 42, 58; 428/141, 143, 144, 148, 195, 206, 207, 209, 333, 336, 403, 469, 472, 539, 220

[56] References Cited

U.S. PATENT DOCUMENTS

| | | | |
|---|---|---|---|
| 3,634,208 | 1/1972 | Kuroda | 204/35 N |
| 3,664,932 | 5/1972 | Patrie | 204/35 N |
| 3,787,295 | 1/1974 | Endinger et al. | 204/35 N |
| 3,915,813 | 10/1975 | Abe et al. | 204/35 N |
| 4,042,468 | 8/1977 | Hasegawa et al. | 204/42 |
| 4,066,516 | 1/1978 | Sato | 204/15 |
| 4,066,816 | 1/1978 | Sheasby et al. | 428/336 |

OTHER PUBLICATIONS

Walter Hubner and A. Schiltknecht, The Practical Anodizing of Aluminum, MacDonald and Evans, London, 1960, pp. 21-26.

*Primary Examiner*—Curtis R. Davis
*Assistant Examiner*—William Leader
*Attorney, Agent, or Firm*—Cooper, Dunham, Clark, Griffin & Moran

[57] ABSTRACT

The invention provides aluminium articles having porous anodic oxide films colored by means of an optical interference effect. In FIG. 4, the article 10 carries a first anodic oxide film 12 with pores 14 enlarged at their inner ends 20 and containing deposits 22. The products may be made by growing a second anodic oxide film 26 underneath the deposits 22 which are preferably of acid-resistant material. X is at least 26 nm, Y is preferably at least 60 nm, Z is preferably 15 nm to 200 nm, (Y+Z) is preferably 75 nm to 600 nm, and W is preferably at least 15 nm.

15 Claims, 4 Drawing Figures

Figure 1:
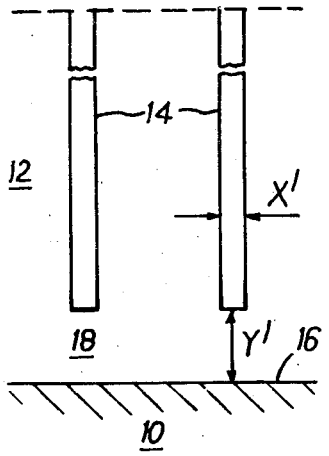

ALUMINIUM ARTICLES HAVING ANODIC OXIDE COATINGS AND METHODS OF COLORING THEM BY MEANS OF OPTICAL INTERFERENCE EFFECTS

This is a continuation, of application Ser. No. 3,891 filed Jan. 16, 1979, now abandoned.

The present invention relates to the production of coloured anodic oxide films on aluminium (including aluminum alloys).

The colouring of anodic oxide films by electrolytic deposition of inorganic particles has become well known. In the electrocolouring process inorganic material is deposited in the pores of the anodic oxide film by the passage of electric current, usually alternating current, between an anodised aluminium surface and a counterelectrode, whilst immersed in an acidic bath of an appropriate metal salt. The most commonly employed electrolytes are salts of nickel, cobalt, tin and copper. The counterelectrode is usually graphite or stainless steel, although nickel, tin and copper electrodes are also employed when the bath contains the salt of the corresponding metal. The deposits of material constitute what are referred to herein as inorganic pigmentary deposits, although the mechanism by which they function to give a coloured appearance is quite different from that of normal organic or inorganic pigments.

In a conventional electrocolouring process, employing, for example, a nickel sulphate electrolyte the colours obtained range from golden brown through dark bronze to black with increase in treatment time and applied voltage. It is believed that in the conventional coloured anodic oxide coatings the dark colours are the result of the scattering and absorption within the coating of the light reflected from the surface of the underlying aluminium metal. The gold to bronze colours are believed to be due to greater absorption of the shorter wave length light, i.e. in the blue-violet range. As the pores of the oxide film become increasingly filled with pigmentary deposits the extent of the absorption of light within the film becomes almost total, so that the film acquires an almost completely black appearance.

It has been shown (G. C. Wood and J. P. O'Sullivan: Electrochimica Acta 15 1865–76 (1970) that in a porous-type anodic aluminium oxide film the pores are at essentially uniform spacing so that each pore may be considered as the centre of an essentially hexagonal cell. There is a barrier layer of aluminium oxide between the bottom of the pore and the surface of the metal. The pore diameter, cell size and barrier layer thickness each have a virtually linear relationship with the applied anodising voltage. Similar relationships hold true within quite small deviations for other electrolytes employed in anodising aluminium, for example chromic acid and oxalic acid.

There have been already described in U.S. Patent Patent No. 4,066,816 products in which a new range of colours was obtained by electrocolouring, the apparent colour being due to optical interference in addition to the scattering and absorption effects already noted.

Since the perceived colour is the result of interference between light scattered from the outer ends (with reference to the aluminium/aluminium oxide interface) of the individual deposits and light scattered from the aluminium/aluminium oxide interface, the outer ends of the individual deposits must be of adequate size, viz. on average at least 26 nm. The colour produced depends upon the difference in optical path resulting from separation of the two light scattering surfaces (the outer ends of the deposits and the aluminium/aluminium oxide interface). The separation, when colouring a particular film, depended on the height of the deposits. It was found that a range of attractive colours, including blue-grey, yellow-green, orange-brown and purple, could be produced by electrolytic colouring when employed interference colouring effects.

According to U.S. Pat. No. 4,066,816, practically useful interference effects were achieved when the distance of the upper surface of the pigmentary deposits was from 50 nm to 300 nm above the aluminium-/aluminium oxide interface. Also, perhaps because of a combination of the absorption effects noted above and the optical interference effects, the colours were somewhat muddy. This limited the colour effects that could be achieved.

We have now found that a significantly brighter appearance, resulting in a coloured film having a characteristic clear coloured appearance, can be achieved by growing additional oxide film beneath the relatively large shallow deposits (larger than 26 nm on average) which give rise to perceived colour by light interference effects. The growth of additional oxide film beneath the deposits results in an increase in the interval between the base of the deposits and aluminium-/aluminium oxide interface.

The possibility of additional oxide film growth beneath inorganic pigmentary deposits in porous anodic oxide films has been described by A. S. Doughty et al in Transactions of the Institute of Metal Finishing, 1975, Volume 53, pages 33 to 39. However, Doughty et al laid down very non-uniform deposits from an acidified solution of silver nitrate. It is not clear whether the subsequent oxide film growth that they claim was either uniform or significant. They did not achieve any colouring by optical interference.

In one aspect, the present invention provides an aluminium article having an anodic oxide coating on its surface including a first porous oxide film having a thickness of at least 3 microns, the pores of said film having inorganic pigmentary material deposited therein, the average size of the said deposits at their outer ends, with reference to the aluminium/aluminium oxide interface, being at least 26 nm, the article being coloured by virtue of optical interference, wherein there is present, between the inorganic pigmentary deposits and the aluminium/aluminium oxide interface, a second oxide film formed subsequent to the first film.

In another aspect the invention provides a method of making such an aluminium article by providing an article having an anodic oxide coating on its surface including a first porous oxide film having a thickness of at least 3 microns, the pores of said film having inorganic pigmentary material deposited therein, the average size of the said deposits at their outer ends, with reference to the aluminium/aluminium oxide interface, being at least 26 nm, the article being coloured by virtue of optical interference, and forming a second oxide film between the bottoms of the said pores and the aluminium-/aluminium oxide interface. A preferred method comprises the steps of (a) forming a porous anodic oxide film at least 3 microns thick on the surface of the article, (b) if the pores have an average cross-section less than 26 nm, increasing the cross-section of the pores towards their inner ends, with reference to the aluminium-/aluminium oxide interface, to an average size of at least 26 nm, (c) forming deposits of inorganic pigmentary material in the thus enlarged regions of the said pores so that the average size of the outer ends, with reference to the aluminium/aluminium oxide interface, of the said deposits is at least 26 nm, (d) effecting further aluminium oxide formation beneath the said deposits so as to increase the distance of the deposits from the aluminium/aluminium oxide interface.

Two or more of the aforesaid steps (b), (c) and (d) may be performed simultaneously wholly or in part as will be illustrated in the Examples. However in relation to the present invention it is particularly important to appreciate that step (d) may be performed either subsequent to or simultaneous with step (c). The term "simultaneous" is here used to mean that the steps concerned are performed in the same treatment bath under the same treatment conditions. It is difficult or impossible to determine whether the physical and chemical changes described are taking place simultaneously.

Reference is made to the accompanying drawings which are diagrammatic sections, not drawn to scale, through anodic oxide coatings on an aluminium article. FIGS. 1, 2, 3 and 4 show the state of the article at the end of steps (a), (b), (c) and (d) respectively of the method defined above.

FIG. 1 shows an aluminium article 10 carrying an anodic oxide film 12 on its surface. The film contains pores 14 of cross-section X' which extend from the outer surface thereof down to a distance Y' from the aluminium/aluminium oxide interface 16. The region 18 between the bottom of the pores and the interface 16 is usually known as the barrier layer.

Figure 2:
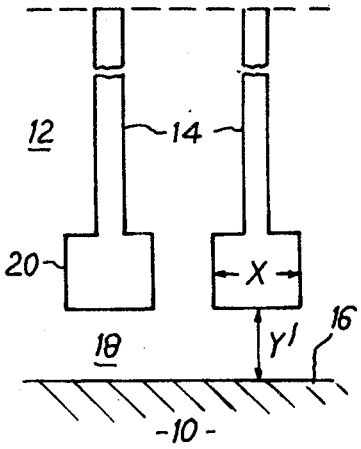

In FIG. 2, the cross-sectional size of the inner ends 20 of the pores 14 has been increased from X' to X.

Figure 3:
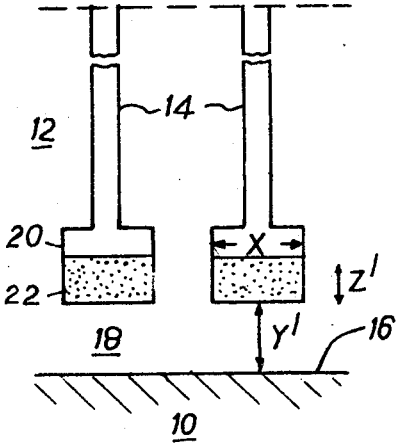

In FIG. 3, inorganic pigmentary material 22 has been deposited to a depth Z' in the enlarged portions 20 of the pores 14.

Figure 4:
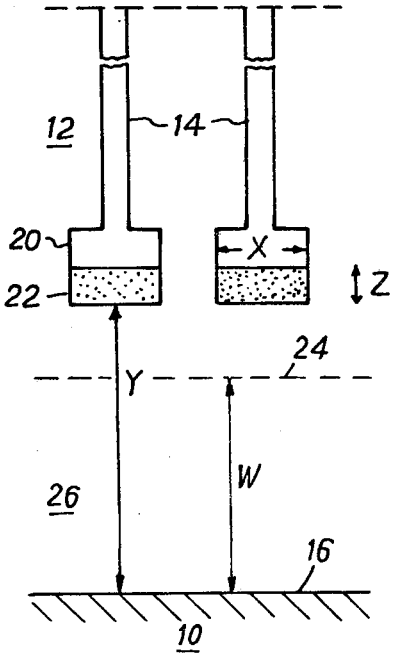

In FIG. 4, the formation of a second aluminum oxide film 26 has been effected to thickness W beneath the deposits 22, thus increasing the distance between the base of those deposits and the aluminium/aluminium oxide interface from Y' to Y. The boundary between old and new oxide film 12 and 26 is shown as 24. Since part of this overall region is now normally porous like the rest of the anodic oxide film, it is no longer appropriate to talk of it as a barrier layer. At the same time, the depth of the inorganic pigmentary material 22 has been altered from Z' to Z. The extent of the alteration between Z' and Z depends on the acid resistance of the material deposited and upon the conditions used; in some cases the difference between Z' and Z is negligible.

The four steps of the method will now be described in greater detail.

(Step a) involves forming a porous anodic oxide film at least three microns thick on the surface of the article and may conveniently be effected in conventional manner. For example, conventional sulphuric acid anodising at 17–18 volts give rise to pores 15 to 18 nm across (X' in FIG. 1), and at a spacing of 40 to 50 nm, with a barrier layer (Y' in FIG. 1) 15 to 18 nm thick. Considering the great length of the pores (typically 10,000–25,000 nm) in relation to their cross-section, it is remarkable that chemical species apparently can and do pass readily up and down them. It is possible but normally less preferable to produce large diameter pores in this step by using an anodising electrolyte for which higher anodising voltages are used.

(Step b) involves increasing the cross-section of the pores towards their inner ends to an average size (X in FIG. 2) of at least 26 nm, and preferably at least 30 nm along at least 200 nm of their length. The purpose of this is to ensure that the outer ends of the inorganic pigmentary deposits (to be laid down in step c)) have an average size of at least 26 nm after completion of step (d). When the pores originally formed in step (a) are of sufficient size, this pore-enlargement step (b) may not be necessary. As previously noted, one way of doing this is described in U.S. Pat. No. 4,066,816 and involves subjecting the anodised article to electrolytic treatment in an electrolyte having a high dissolving power for aluminium oxide such as phosphoric acid. This prior patent particularly describes treatment under direct current conditions, but we have surprisingly found that somewhat more intense colours can be produced if the electrolytic treatment in an electrolyte having a high dissolving power for aluminium oxide is carried out at least in part under alternating current conditions. The explanation for this difference appears to reside in the surprising fact that a greater proportion of the originally small diameter pores are modified in the course of the phosphoric acid treatment under alternating current conditions that if D.C. is used in this step. There appears to be a tendency in the electrocolouring stage for the unmodified pores to receive the relatively small diameter and relatively deep deposits of the conventional electrocolouring process. The perceived colour is due to the combination of the optical interference effects due to the relatively large diameter shallow deposits in the modified pores and the light absorption effects are due primarily to the much deeper small diameter deposits in the unmodified pores. The light absorption effects due to the deep small diameter deposits impart a certain "muddiness" (bronze overtone) to the perceived colour of the film. A significant decrease of the proportion of unmodified pores should significantly decrease the light absorption effects. Additionally, the degree of enlargement of the pores brought about by the use of A.C. treatment under given conditions of time, temperature, voltage and acid concentration is greater than that obtained by D.C. treatment under similar conditions.

This invention contemplates the use of direct current and/or alternating current for this purpose. Direct current voltages are generally in the range 8 to 50 volts; alternating current voltages are generally in the range 5 to 40 volts at temperatures in the range up to 50° C., preferably 15°–25° C., and phosphoric acid concentrations preferably in the range 10–200, particularly 50–150, grams/liter. The upper limit of a dissolution treatment designed to increase pore diameter is set by the point where the film loses strength and becomes powdery or crumbly through reduction of the thickness of oxide lying between adjacent pores. With a conventional sulphuric acid-anodised film where the initial density of the film is about 2.6–2.8 gms/cm$^3$ the density can be reduced to about 1.8 gms/cm$^3$ before the film starts to become powdery, although it is clearly desirable to minimise bulk film dissolution.

Where pore enlargement involves dissolving the oxide film, it may have the subsidiary effect of reducing the thickness Y' of the barrier layer beneath the pores.

(Step c) involves depositing inorganic pigmentary material in the thus-enlarged region of the pores so that the average size of the outer ends is at least 26 nm, preferably at least 30 nm. This step may be performed simultaneously with step (d) or separately before step (d). When step (c) is performed separately, this may conveniently be done as described in U.S. Patent No. 4,066,816.

The inorganic pigmentary material is preferably metal-containing material in which the metal is one or more of tin, nickel, cobalt, copper, silver, cadmium, iron, lead, manganese and molybdenum.

One difficulty that has been experienced in the commercial development of colouring anodic oxide films by means of optical interference effects in change in colour between the end of the electrocolouring stage and the final sealing stage. This change is believed to be the result of slight redissolution of the deposited pigmentary material by the acid electrolyte remaining in the pores. This has the effect of reducing the separation between the outer ends of the pigmentary deposits and the aluminium/aluminium oxide interface. This difficulty can be largely overcome by immediately dipping the work in a fixative, such as a chromate bath, but that expedient is generally inconvenient in a commercial operation by reason of the possibility of delay between the electrocolouring operation and the subsequent fixative dip. Such a delay could occur, for example, by the temporary nonavailability of overhead lifting gear, employed for the transfer of work between operating stages of the process.

We have now found that a further very significant improvement in the production of anodised aluminium, coloured by light interference effects, can be achieved by depositing acid-resistant material to form the pigmentary deposits in the pores of the anodic oxide film in the electrocolouring stage. In most instances such deposits are formed by very intimate codeposition of two metals, which are known to form acid-resistant alloys. Where the deposits consist (or consist largely of) an acid-resistant material there is little change in colour between the completion of the electrolytic colouring stage and the subsequent washing stage in which acid is removed from the pores. Where additional oxide film is grown beneath pigmentary deposits, during or after their deposition, the permformance of the operation is greatly simplified if the deposits are resistant to redissolution during the anodising treatment.

It is of course well known that certain alloys such as Sn-Ni and Cu-Ni are very resistant to attack by strong acid. It is possible to deposit acid-resistant deposits from a colouring bath containing salts of the two metals. It is also possible for one metal, for example Sn, to be deposited in the pores in a first treatment stage and the second metal, for example Ni, to be contained in the electrolyte of a subsequent electrolytic treatment stage. It appears that in the subsequent A.C. colouring treatment with a Ni electrolyte, the already deposited Sn in the pores redissolves during one half of the A.C. cycle and redeposits with Ni during the other half cycle to form acid-resistant Sn-Ni deposits in the pores. While most experimental work has so far been carried out on the deposition of Sn-Ni and Cu-Ni, available knowledge of the acid resistance of alloys of metals which can be deposited in this type of electrolytic treatment, suggests that deposition of pigmentary material containing Cu-Co, Cu-Mn, Mn-Ni, Ni-Mo, Mn-Co and other such acid resistant alloys will lead to similar satisfactory results.

The height of the deposit Z′ depends on the time of treatment and can be controlled as described in the aforementioned U.S. Patent. To ensure opacity, at least 15 nm depth should be deposited. For the purpose of this invention, no critical upper limit is placed on the value of Z′, through Z′ will generally be in the range 15 to 500 nm.

Each individual column of pigment 22 in the finished product makes its own contribution to the optical interference colour. In order that a strong interference colour be generated, it is desirable that, in the finished product, the variation of the height Y+Z between individual deposits should be minimised. To this end it is preferred that variations between the heights Z′ of individual deposits laid down in step (c) should be minimised. In other words, we aim at uniform deposition of the inorganic pigmentary deposits.

It is believed that the thickness of the barrier layer Y′ at the conclusion of steps (a) and (b) is substantially uniform over the surface of the article. At this point the article is placed in an aqueous solution of a metal salt and a voltage applied. If the voltage is higher than the voltages applied in step (a) or in step (b) (when the latter step is dominant) then inorganic pigment deposition takes place in the usual way. If the voltage is lower than the aforementioned voltages, secondary pore formation in the barrier layer has to take place before pigment deposition can begin; that is to say, there is an induction period before pigmentary deposits begin to be laid down. It is believed that this secondary pore formation may not be uniform. Accordingly it is preferred to perform step (c) using an applied voltage which is high enough such that there is no substantial induction period before commencement of pigment deposition.

(Step d) involves further aluminum oxide formation beneath the pigmentary deposits laid down in step (c) so as to increase the distance of the deposits from the aluminium/aluminium oxide interface from Y′ to Y. This may conveniently be done in a separate electrolytic bath containing a known anodising agent such as sulphosalicylic acid, oxalic acid, tartaric acid or sulphuric acid. Since the desired film growth is only at most a few hundred nm, mild conditions can be employed. While various conditions and anodising current forms (e.g. A.C., D.C., pulsed current etc) may be used for this purpose, we prefer to use alternating current, for example at 8 to 50 volts with temperatures up to 50° C. and times up to 20 minutes, at sulphosalicyclic acid concentrations of 1 gram/liter upwards, preferably 5 to 200 grams/liter.

The value of Y′ is typically 15 to 18 nm. According to this invention, this is preferably increased in step (d) to more than 60 nm, particularly more than 75 nm. There is no critical upper limit for Y, but beyond 500 nm the range of interference colours obtainable is more limited.

As shown in FIG. 4, the additional film growth takes place at the aluminium/aluminium oxide interface 16 and results in the formation of a second film 26 of thickness W beneath the first oxide film 12, the two films adjoining along an interface 24. This interface 24 will not usually be detectable in the finished product. However, when this additional film growth is effected using a pore-forming anodising agent, there may be formed additional pores extending down from the original pore 14 and across the interface 24, (these have not been shown in the Figure). The existence of such additional pores in the finished product may thus be taken as an indication that a second oxide film has indeed been formed according to this invention. However the converse, that the absence of additional pores implies the absence of a second oxide film, does not hold; the second oxide film could be formed using a non-porous film forming electrolyte such as boric acid. Useful improvements in clarity and brightness of colour can be achieved by as little as 15 nm of additional film growth (i.e. W at least 15 nm). More usually however, additional oxide film at least 30 nm, preferably at least 60 nm, thick is grown in this step. The depth Z of the pigmentary deposit after completion of step (d) is generally in the range 30 to 200 nm. If the depth Z′ of the deposit laid down in step (c) is uniformly greater than this, then the excess appears to dissolve electrochemically during performance of step (d), though some deposits are more readily dissolved than others.

According to U.S. Pat. No. 4,066,816, the height of the top surface of the deposits above the aluminium-/aluminium oxide interface is 50 to 300 nm. The lower figure of 50 nm results essentially from optical theory considerations but the upper figure of 300 nm represents a practically useful limit in the operation of the invention described in the said specification and is without particular theoretical significance. Indeed, it is known that the colours resulting from optical interference effects are produced in repetitive cycles as the optical path difference increases. These cycles are generally referred to as 'first order effects', 'second order effects', 'third order effects' and so on. Optical interference occurring in the second and higher orders may involve separation distances substantially greater than 300 nm. It is postulated that the limitation of 300 nm in U.S. Pat. No. 4,066,816 results from the following two effects:

1. Firstly, it is generally acknowledged that, for the optimum production of interference effects (that is the production of the strongest colours), the amounts of light scattered from the two surfaces should be approximately equal. In the operation of the invention described in U.S. Pat. No. 4,066,816 the pigmentary material whose outer ends are to form one of the scattering surfaces, is deposited in the enlarged lower portions of the pores of the anodic film formed in the earlier part of the process. By referring to FIG. 3 it will be seen that the inner ends of such deposits are separated from the aluminium/aluminium oxide interface by a distance Y′, the intervening space being filled with clear aluminium oxide (refractive index 1.6–1.7); this is the barrier layer portion of the anodic film and, typically, distance Y′ is very small, of the order of 15–20 nm. The pigmentary material deposited in the pores clearly presents a physical obstruction to light reaching the scattering surface of the aluminium/aluminium oxide interface and returning to the eye of the viewer. Since the distance Y′ is so small, the geometry of the system indicates that the obstructive effect is relatively large; however within the parameters of the invention of U.S. Pat. No. 4,066,816 the obstructive effect mentioned appears to allow a sufficient contribution of the light scattered from the aluminium/aluminium oxide interface to produce strong and useful interference effects. Nevertheless it is evident that, as one deposits additional pigmentary material into the pores so as to produce other colours in the spectral series, distance Z′ increases and there is a progressive reduction in the contribution of light scattered from the aluminium/aluminium oxide interface. Eventually this results in a weakening of the interference effect.

2. The second effect results from the fact that some of the light entering the anodic film in an angular direction must strike the sides of the pigmentary deposits along dimension Z′. Such light is scattered and largely absorbed within the film. These absorption effects impart a slight bronze tone or 'muddiness' to the colour observed. There must always be some degree of bronze tone superimposed upon the interference colours observed but within the parameters of the above Specification this does not detract significantly from the usefulness of the invention. It will be obvious, however, that as distance Z′ is increased by the introduction of further pigmentary material, the absorption effects must also increase with a consequent progressive increase in bronze overtone or 'muddiness'.

The combined result of these two effects is that at separation distances greater than about 300 nm the interference effects have become so weakened and the bronze tone has become so predominant that the interference colour effects are hardly useful for commercial purposes.

By contrast, the process of the present invention involves raising the height above the aluminium-/aluminium oxide interface of short columns of pigmentary deposit.

It will readily be appreciated that, as a result, the two adverse effects described above which limit the scope of the invention of U.S. Pat. No. 4,066,816 are largely circumvented. The increase in the interval between the base of the deposits and the aluminium/aluminium oxide interface renders the geometry of the system more favourable to the passage of light to and from the aluminium/aluminium oxide interface. Furthermore, since the height of the deposit (distance Z) is small and remains substantially constant for the whole range of colours, there is no increase of absorption and development of bronze tones as the colours later in the series are produced. In consequence clear bright interference effects are obtained even in the second and higher orders. When the columnar height Z of the deposits is in the range 15 to 150 nm, the spacing between the outer surface of the deposits and the aluminium/aluminium oxide interface (Z+Y) may be from 75 nm up to 600 nm or 1,000 nm or even greater. Products which exhibit the clear bright interference colours obtained by the practice of this invention are believed to be entirely new and moreover such colours can be produced equally well when the distance (Z+Y) is greater than 300 nm as when it is in the range 50–300 nm.

The following Table 1 sets out the spacings (Z+Y) between the outer surface of the deposits and the aluminium/aluminium oxide interface at which interference effects are observed. The figures in the Table must be taken as approximate only; they are based on the assumption of a refractive index of 1.7 for the aluminium oxide of the anodic film.

TABLE I

| Number of Wavelengths | INTERFERENCE | | | |
|---|---|---|---|---|
| | Constructive (nm) | | Destructive (nm) | |
| | Violet | Red | Violet | Red |
| 0.5 | | | 60 | 110 |
| 1.0 | 120 | 210 | | |
| 1.5 | | | 180 | 310 |
| 2.0 | 240 | 410 | | |
| 2.5 | | | 300 | 515 |
| 3.0 | 350 | 620 | | |
| 3.5 | | | 410 | 720 |

Alternatively, steps (c) and (d) can be carried out in one operation. When the further anodising is carried out in the electrocolouring bath itself, it is found, surprisingly, that it is possible to achieve this result without change of the applied voltage or other conditions used in the colouring step. The mechanism by which this is achieved is not fully understood.

From observation of specimens in the course of treatment it appears that pigmentary deposits are formed in the pores at the beginning of electrolytic treatment in the electrocolouring bath. After formation of initial deposits there appears to be some increase in resistance leading to a change in conditions within the pores to a situation which favours the growth of additional oxide film. In consequence further film grows beneath the deposits to increase the interval between the deposits and the aluminium/aluminium oxide interface.

It will be readily apparent that the growth of further anodic oxide film in the electrocolouring bath under A.C. conditions will require the presence of the correct anions for anodic film formation as well as an appropriately low pH. Since the extent of further oxide formation is at most only a few hundred nm in thickness, it is sufficient that anodising should proceed at a very low rate. In consequence the acidity of the electrocolouring bath may be much lower (that is the pH may be higher) than that normally employed for anodising in the presence of the same anions. The pH value of the electrolyte is set at a level which results in an appropriate rate of anodic oxide growth without excessive redissolution of the deposited pigmentary material.

To perform steps (c) and (d) together, the bath needs to contain an anodising acid. Preferably the anodising electrolyte has a pH of from 0.5 to 2.0. If the pH is too low, the deposit is re-dissolved as fast as it is laid down, and if the pH is too high, little or no aluminium oxide growth takes place. Within this pH range the metal salt concentration, the temperature and the applied voltage need to be correlated to obtain the best results. If the deposit is laid down very fast, there is no opportunity for aluminium oxide formation to take place under it; this difficulty can be avoided by keeping down the metal salt concentration. We prefer to use alternating current at voltages of 8 to 50 volts with temperatures up to 50° C. and times up to 20 minutes. It will be appreciated that the rate of deposition depends on the combination of conditions of time, voltage, salt concentration and pH and many permutations of such conditions are possible. Having set one parameter the other parameters must be adjusted accordingly; for example if higher voltages are used this implies the need for lower metal salt concentrations and/or lower pH.

The products of this invention are characterized by clear bright colours quite different from anything obtainable according to U.S. Pat. No. 4,066,816.

Reference is made in this patent to the "size" or the "cross-section" or the "cross-sectional size" or the "average size" of the pores or deposits. These terms all have essentially the same meaning in the present context. Our measurements have been made by the following procedure; it is possible that other procedures might give rise to somewhat different results.

After film formation thin strips were cut from the specimens. Each strip was mounted in a 00 size BEEM polyethylene capsule such that the strip was parallel to the axis of the capsule so subsequent sectioning perpendicular to that axis gave a near true film thickness. The encapsulating resin consisted of Epon 812, DDSA and DMP-30 (obtained from Polaron Equipment Ltd.) in the proportions 20:30:1, and curing was carried out at 60° C. for 72 hrs.

An LKB Instruments Ltd. Ultrotome III 8800 ultramicrotome was employed to produce the sections. Before sectioning the tip of the specimen block was trimmed with a glass knife to form a truncated pyramid having an included semi-angle of 60°. The area presented to the knife was shaped to a parallel sided trapezium of about $0.1\times0.1$ mm, the specimen being so orientated as to allow the surface coating to be cut in a direction parallel to its interface with the substrate. The sections were produced using a diamond knife of cutting angle about 45°, set with a clearance angle of 2°. The cutting speed and sectioning thickness were generally set at 0.5 mm $s^{-1}$ and 25 nm respectively, although it is believed that the sections were possibly as thick as 50 nm. Ribbons of slices produced were collected from the knife water bath onto 400 mesh copper grids, dried and examined in a transmission electron microscope.

Measurements of film parameters and deposit sizes were made directly from electron micrographs.

The invention is hereinafter further discussed with reference to the following Examples.

The Examples have been grouped for convenience, with reference to the four steps of the preferred method of the invention:

step (a) anodising,
(b) pore-enlargement,
(c) deposition of inorganic pigmentary material,
(d) anodising beneath the deposit.

The Examples are grouped as follows:

(A) Steps (c) and (d) performed simultaneously
  (i) acid-resistant deposits—Examples 1 to 6
  (ii) non-acid-resistant deposits—Examples 7 to 9
(B) Step (d) performed (or at least completed) subsequent to step (c)
  (i) acid-resistant deposits—Examples 10 to 16
  (ii) non-acid resistant deposits—Examples 17 and 18.

Alternating current has been used wholly or partly for pore-enlargement in step (b) in Examples 1, 2, 3, 5, 6, 7, 8, 10, 11, 12, 14, 16, 17 and 18.

Against the colours produced in each Example are given figures for the average height of the outer ends of the inorganic pigmentary deposits above the aluminium/aluminium oxide interface ($Z+Y$, or $Z'+Y'$ where step (d) has not been performed. This distance is called the deposit height in the following Examples). These figures are estimates, based on the predictions of an interference model using Table I above, and assuming a refractive index of 1.7 for the anodic film beneath the deposits. In certain cases, marked with a *, electron-optical data for the values of X, Y, Z and $Y+Z$ have been obtained are are tabulated separately in Table III below. In addition, electron-optical data are given in Example 16.

In the Examples, unless otherwise stated, the samples were flat extruded bars of an aluminium-magnesium-silicon alloy of the AA 6063 type. After conventional degreasing, etching, desmutting and washing pretreatment, these samples were (except where stated otherwise) first anodised in a 165 g/l sulphuric acid electrolyte at 17.5 volts and 20° C. for 30 minutes to give an anodic film thickness of approximately 15 microns. The subsequent treatments varied as indicated. Graphite rod electrodes were used both for electrolytic pore enlargement in phosphoric acid and usually in the subsequent electrocolouring stage. However, when a nickel-containing electrolyte was used in step (c) the counter-electrodes were carbon rods or nickel or stainless steel strips or rods.

EXAMPLE 1

In this Example, the sequence of operations is-
(Steps (a)
(b)+½ (c)
½ (c)+(d).

An extrusion, 75 mm×75 mm in size, of an aluminium-magnesium-silicon alloy of the AA6063 type was degreased in an inhibited alkaline cleaner, etched for 10 minutes in a 10% sodium hydroxide solution at 60° C., desmutted, and then anodised under direct current at 17 volts in a 165 g/l sulphuric acid electrolyte for 30 minutes at a temperature of 20° C. and a current density of 1.5 A/dm$^2$ to give an anodic oxide film thickness of about 15 microns. It was then treated in a phosphoric acid-tin salt bath containing 105 g/l $H_3PO_4$ and 1 g/l stannous sulphate. Direct current was used first for 2 minutes at 10 volts followed by alternating current for 4 minutes at 10 volts. The bath temperature was 23° C. The panel was then coloured in an electrolyte containing 50 g/l nickel sulphamate, brought to pH 1.3 by addition of sulphuric acid, at 23 volts for times of 2 to 10 minutes. The colours and deposit heights produced were as follows:

| | | |
|---|---|---|
| 2 minutes | blue | 110 nm |
| 4 minutes | clear light blue | 140 nm |
| 6 minutes | clear yellow | 180 nm |
| 8 minutes | clear orange red | 210 nm |
| 10 minutes | clear light purple | 240 nm |

These colours were exceptionally bright and clear with no muddy overtones.

In this case change in colouration due to further growth of anodic oxide film rather than increase in height of the pigmentary deposits appears to have commenced after about 4 minutes treatment time.

EXAMPLE 2

In this Example the sequence of operations is
Steps (a)
(b)+½(c)
½(c)+(d).

An Al-Mg-Si sample was anodised in sulphuric acid as in Example 1, then treated in the same phosphoric acid-tin both under A.C. conditions only for 4 minutes at 10 volts. It was coloured in an electrolyte containing 50 g/l nickel sulphamate, 150 g/l magnesium sulphate and sulphuric acid to bring the pH to 1.1 at a voltage of 25 volts for times of 2 to 10 minutes. The colours and deposit heights obtained were as follows:

| | | |
|---|---|---|
| 2 minutes | clear blue-grey | 150 nm |
| 4 minutes | clear yellow | 180 nm |
| 6 minutes | clear orange red | 210 nm |
| 8 minutes | clear violet | 250 nm |
| 10 minutes | clear blue green | 290 nm |

Again these colours were very bright and clear as in Example 1 and in each case is believed to be due to growth of anodic oxide below the deposited pigmentary material.

EXAMPLE 3

In this Example the sequence of operations was
Steps (a)
(b)
(c)+(d).

The sample was $H_2SO_4$ anodised and then treated in 100 g/l $H_3PO_4$ at 22° C. for 4 minutes using an A.C. voltage of 10 volts. It was coloured in a bath containing
50 g/l nickel sulphamate
150 g/l magnesium sulphate
1 g/l stannous sulphate
pH 1.5 (adjusted by addition of sulphuric acid)
Temperature 22° C.

An A.C. colouring voltage of 20 volts was used and colouring was carried out for times between 20 seconds and 10 minutes. The colours and deposit heights achieved were as follows:

| | | |
|---|---|---|
| 20 seconds | purplish blue | 120 nm |
| 2 minutes | clear light blue | 140 nm |
| 4 minutes | clear grey green | 160 nm |
| 6 minutes | clear yellow | 180 nm |
| 8 minutes | clear orange | *200 nm |
| 10 minutes | clear red purple | 220 nm |

In this Example the colouration was the result of co-deposition of Sn and Ni pigmentary deposits at the beginning of the treatment followed by growth of fresh anodic film beneath the deposits to give the characteristic clear colours at treatment times of 2 to 10 minutes.

EXAMPLE 4

In this Example the sequence of operations was
Steps (a)
(b)+(c)+(d).

The sample was $H_2SO_4$ anodised. Pore enlargement under D.C. conditions with subsequent formation of pigmentary deposits and anodising under the deposits under A.C. conditions were all performed in the same bath having the following composition:
100 g/l $H_3PO_4$
50 g/l nickel sulphamate
1 g/l stannous sulphate
pH 1.2
Temperature 24° C.

A D.C. voltage of 10 was used for 4 minutes to commence pore enlargement. Further treatment was carried out with an A.C. voltage of 20 volts for 1 to 6 minutes. At the beginning of the A.C. treatment there was a steady increase in current accompanied by deposit of pigmentary material and development of colour. The current then became substantially constant and so remained during the remainder of the test. The colours and deposit heights obtained were as follows:

| | | |
|---|---|---|
| 1 minute | dark blue | 90 nm |
| 2 minutes | clear light blue | 130 nm |
| 3 minutes | clear grey blue | 150 nm |
| 4 minutes | clear yellow green | 170 nm |
| 5 minutes | clear yellow orange | 190 nm |
| 6 minutes | clear purple | *230 nm |

The first stage (1 minute) is typical of the dark initial colours produced by pigment deposition. The colours produced in the remainder of the test were typical of colours produced by anodising under the deposits.

EXAMPLE 5

In this Example the sequence of operations was
Steps (a)
(b)+½(c)
½(c)+(d).

The sample was anodised in sulphuric acid and then treated in a 100 g/l phosphoric acid electrolyte containing 1 g/l cupric sulphate for 4 minutes at 10 volts A.C. It was then coloured in a bath containing 50 g/l nickel sulphamate and 150 g/l magnesium sulphate at a pH of 1.5 and at a temperature of 20° C. to develop acid-resisting deposits containing Cu-Ni alloy. A colouring voltage of 25 volts A.C. was used for times of 2 to 12 minutes. The following colours and deposit heights were obtained:

| | | |
|---|---|---|
| 2 minutes | dark purplish blue | 80 nm |
| 4 minutes | clear grey blue | 150 nm |
| 6 minutes | clear yellow | 180 nm |
| 8 minutes | clear light orange | 200 nm |
| 10 minutes | clear orange red | 210 nm |
| 12 minutes | clear red purple | 220 nm |

This colour range is very similar to that obtained with the tin-nickel systems and the colours obtained at 4 to 12 minute stages indicate anodising under the pigmentary deposits.

EXAMPLE 6

In this Example the sequence of operations was
Steps (a)
(b)
(c)+(d)

This sample was anodised in sulphuric acid and then treated in a 100 g/l phosphoric acid electrolyte at 20° C. for 4 minutes using an A.C. voltage of 10 volts. It was coloured in a bath containing 50 g/l nickel sulphamate, 1 g/l cupric sulphate and 150 g/l magnesium sulphate at a pH of 1.5 (sulphuric acid added) and at a temperature of 23° C. Colouring was carried out at 20 volts A.C. for times of 1 to 12 minutes. The colours and deposit heights obtained were as follows:

| | | |
|---|---|---|
| 1 minute | dark purplish blue | 80 nm |
| 2 minutes | medium to dark blue | 100 nm |
| 4 minutes | medium blue | 120 nm |
| 6 minutes | clear light blue | 140 nm |
| 8 minutes | clear green yellow | 160 nm |
| 10 minutes | clear yellow | 180 nm |
| 12 minutes | clear orange | 200 nm |

All these colours were strong and those produced in the range 6 to 12 minutes represented anodising beneath the existing deposit.

EXAMPLE 7

In this Example the sequence of operations was
Steps (a)
(b)
(c)+(d).

The sample was anodised in sulphuric acid and then treated in a 100 g/l phosphoric acid electrolyte at 20° C. for 4 minutes using an A.C. voltage of 10 volts. It was coloured in an electrolyte containing 7.5 g/l stannous sulphate and 80 g/l aluminium sulphate adjusted to pH 0.5 by addition of sulphuric acid at a temperature of 22° C. An A.C. colouring voltage of 10 volts was used for times of 2 to 5 minutes. The following strong clear colours and deposit heights were obtained:

| | | |
|---|---|---|
| 2 minutes | clear gold | 160 nm |
| 3 minutes | strong clear yellow | 180 nm |
| 4 minutes | strong clear orange | 200 nm |
| 5 minutes | strong clear purple | *230 nm |

EXAMPLE 8

In this Example the sequence of operations was
Steps (a)
(b)
(c)+(d).

The sample was anodised in sulphuric acid and treated in phosphoric acid under the same conditions as in Example 7 (4 minutes at 10 volts A.C.). It was then coloured in a bath containing 50 g/l nickel sulphamate and 150 g/l magnesium sulphate adjusted to pH 1.5 by sulphuric acid addition and at a temperature of 24° C. An A.C. colouring voltage of 20 volts was used for times of 1 to 10 minutes and the following colours and deposit heights were obtained:

| | | |
|---|---|---|
| 1 minute | dark blue | 90 nm |
| 2 minutes | medium blue | 110 nm |
| 4 minutes | clear light blue | 130 nm |
| 6 minutes | pale green blue | 150 nm |
| 8 minutes | very pale yellow | 170 nm |
| 10 minutes | very pale orange | 190 nm |

This sample illustrates the problem of colour loss through re-dissolution of nickel, not co-deposited with another metal with which it can form an acid-resistant alloy. After each colouring stage the sample had to be dipped in a dilute sodium dichromate solution in order to maintain colour, but even so the colours grew steadily weaker as colouring progressed. The colours produced at 1 and 2 minutes were probably both due to metal deposition without anodic oxide growth and the rest were typical of colours resulting from anodising under the deposit.

EXAMPLE 9

In this Example the sequence of operations was
Steps (a)
(c)+(d).

In this Example anodising was carried out under high voltage conditions to provide a porous-type anodic oxide film having pores of a size sufficiently large to receive pigmentary deposits of an average size in excess of 260 A without any electrolytic pore enlargement treatment.

The sample was anodised in 90 g/l oxalic acid at 35 volts D.C. at a temperature of 28° C. for 30 minutes to provide an anodic oxide film thickness of 8 microns.

It was then coloured in an electrolyte containing 41.5 g/l stannous sulphate, acidified to pH 0.9 by addition of sulphuric acid, at 22° C., using 35 volts A.C. The treatment was continued for 5 minutes and the sample acquired a clear greenish-blue colour, at which point the estimated average height of the outer end of the deposit above the aluminium/aluminium oxide interface was *150 nm. This colour appears to be due to formation of tin pigmentary deposits followed by anodising beneath the deposits.

EXAMPLE 10

In this Example the sequence of operations was
Steps (a)
(b)+½(c)
½(c)
(d).

A test was performed to establish that the clear bright colours obtained in Examples 1 and 2 were due to or assisted by growth of additional anodic oxide film. In this case a sample was subjected to A.C. anodising in sulphuric acid after an initial deposition of pigmentary material in a phosphoric acid-tin bath, followed by colouring in an acid nickel bath.

The $AlMg_2Si$ sample was anodised in sulphuric acid as in Example 1 and then treated in the phosphoric acid-tin bath for 4 minutes at 10 volts A.C. It was then placed in the nickel sulphamate colouring bath of Example 1 for 2 minutes at 10 volts A.C. The colour at this stage was blue (estimated deposit height, 110 nm). It was then placed in a 10 g/l sulphuric acid electrolyte and anodised under A.C. conditions at 25 volts and at a temperature of 20° C. for times of ½ to 10 minutes. The colours and deposit heights produced were as follows:

| | | |
|---|---|---|
| ½ minute | light grey blue | 140 nm |
| 4 minutes | light orange | 200 nm |
| 6 minutes | light purple | 240 nm |
| 8 minutes | light blue green | 290 nm |
| 10 minutes | light orange red | 350 nm |

These colours had the same clarity as those produced in Examples 1 and 2 but were distinctly lighter. In this case no metal deposition could take place in the final sulphuric acid electrolyte and the change of colour was solely due to growth of new anodic film below the deposited alloy layer. Since there is no deposition in the final anodising stage, the colour becomes lighter in comparision with Example 2 through redissolution of deposited materials.

EXAMPLE 11

In this Example the sequence of operations was
Steps (a)
(b)+½(c)
½(c)
(d).

The sample was anodised in sulphuric acid, then treated in an electrolyte containing 100 g/l phosphoric acid, 1 g/l stannous sulphate and 2 g/l aluminium sulphate at 24° C. for 3 minutes at 10 volts A.C. to effect pore enlargement and tin pigment deposition. It was coloured for 2.5 minutes at 15 volts A.C. in a 50 g/l nickel sulphamate solution at pH 1.5 and a temperature of 22° C. to give the dark purplish-blue colour noted in earlier Examples.

The sample was then taken from the colouring bath and anodised in an electrolyte containing 20 g/l sulphosalicylic acid at 25 volts A.C. and 22° C. for times of 1 to 6 minutes. The following colours and deposit heights were obtained:

| | | |
|---|---|---|
| 0 minute | dark purplish blue | 80 nm |
| 1 minute | medium blue | 110 nm |
| 2 minutes | clear light blue | 140 nm |
| 3 minutes | clear green yellow | 160 nm |
| 4 minutes | clear yellow | 180 nm |
| 5 minutes | clear orange | 200 nm |

-continued

| | | |
|---|---|---|
| 6 minutes | clear purple | 230 nm |

This illustrates how virtually identical ranges of colour can be developed after initial formation of pigmentary deposits, by anodising in an acid electrolyte known to be of the anodising type.

Examples 10 and 11 may be used to compare step (d) treatments in different acids. In Example 10 the colours produced are slightly lighter because the sulphuric acid electrolyte dissolves deposited metal to a greater extent than does the sulphosalicylic acid electrolyte used in Example 11.

EXAMPLE 12

In this Example the sequence of operations was
Steps (a)
(b)
(c)
(d).

An Al-Mg-Si sample was anodised as in Example 1. It was then treated in phosphoric acid (100 g/l $H_3PO_4$) for 4 minutes at 10 volts A.C. (23° C.). It was then transferred to a colouring electrolyte containing:
50 g/liter nickel sulphamate
1g/liter cupric sulphate
150 g/liter magnesium sulphate
pH 1.5 (adjusted with $H_2SO_4$)
Temperature 20° C.

It was coloured at an A.C. voltage of 20 volts for 1 minute to give a dark purple blue colour (deposit height, 80 nm).

The sample was then transferred to a 20 g/l sulphosalicylic acid solution at 21° C. and anodising was carried out at 25 volts A.C. for times of 1 to 9 minutes to cause growth of additional oxide film beneath the material deposited in the preceding stage. The following colours and deposit heights were obtained:

| | | |
|---|---|---|
| 1 minute | medium blue | 110 nm |
| 3 minutes | clear light blue | 140 nm |
| 5 minutes | clear yellow green | 170 nm |
| 7 minutes | clear orange | 200 nm |
| 9 minutes | clear blue purple | 250 nm |

EXAMPLE 13

In this Example the sequence of operations was
Steps (a)
(b)
(c)
(d).

An Al-Mg-Si sample was treated identically as in Example 12 except that the pore-enlargement treatment in the phosphoric acid electrolyte was carried out under D.C. conditions for 6 minutes at 10 volts.

After colouring in the copper-nickel bath for 1 minute at 20 volts A.C. the colour of the sample was grey purple (deposit height, 80 nm). After anodising in the sulphosalicylic acid electrolyte at 25 volts the following colours and deposit heights were obtained:

| | | |
|---|---|---|
| 1 minute | medium blue grey | 110 nm |
| 3 minutes | light blue | 140 nm |
| 5 minutes | clear yellow green | 170 nm |
| 7 minutes | clear orange | 200 nm |

-continued

| | | |
|---|---|---|
| 9 minutes | clear blue purple | 250 nm |

The initial colour after treatment in the copper-nickel bath is different in Examples 12 and 13, depending upon whether A.C. or D.C. is used in the phosphoric acid stage; however after anodising in sulphosalicylic acid, clear bright colours are produced in both Examples. Colours brought about by anodising beneath the deposits tend to be very similar irrespective of whether A.C. or D.C. is used in step (b).

EXAMPLE 14

In this Example the sequence of operations was
Steps (a)
(b)
(c)
(d)

An Al-Mg-Si sample was sulphuric acid anodised as in Example 1. It was then treated in phosphoric acid (100 g/l $H_3PO_4$) for 4 minutes at 20 volts A.C. (20° C.). It was then coloured in an electrolyte containing 0.45 g/l silver nitrate and 20 g/l magnesium sulphate at 24° C. and pH 1.2 (adjusted with $H_2SO_4$) for 2.5 minutes at 15 volts A.C. At this stage the colour of the sample was yellow bronze (deposit height, 110 nm).

It was then transferred to a 20 g/l sulphosalicylic acid electrolyte at 24° C. and anodising carried out at 25 volts A.C. for 1 to 9 minutes, the following colours and deposit heights being obtained:

| | | |
|---|---|---|
| 1 minute | light yellow bronze | 140 nm |
| 2 minutes | yellow grey | 160 nm |
| 4 minutes | clear yellow | 180 nm |
| 5 minutes | clear orange | 200 nm |
| 6 minutes | clear orange red | *210 nm |
| 9 minutes | purple grey | 240 nm |

EXAMPLE 15

In this Example the sequence of operations was
Steps (a)
(b)
(c)+(d)
(d).

An $AlMg_2Si$ sample was sulphuric acid anodised as in Example 1. It was then treated in 100 g/l phosphoric acid for 6 minutes at 10 volts D.C. (19° C.) and then coloured in a bath containing the following:

50 g/l nickel sulphamate
1 g/l cupric sulphate
150 g/l magnesium sulphate
pH 1.5 (adjusted with $H_2SO_4$)
Temperature 20° C.

Colouring times of 1 to 9 minutes were used at an A.C. voltage of 20 volts. The colours and deposit heights obtained were as follows:

| | | |
|---|---|---|
| 1 minute | grey purple | 80 nm |
| 3 minutes | medium blue grey | 100 nm |
| 5 minutes | light blue grey | 120 nm |
| 7 minutes | clear light blue | 140 nm |
| 9 minutes | clear green yellow | 160 nm |

The clear light colours obtained after 7 minutes treatment suggests that some formation of additional anodic oxide film beneath the pigmentary deposits had already commenced.

The sample was then transferred to an anodising electrolyte of 20 g/l sulphosalicyclic acid at 19° C. and anodising was continued for 1 to 7 minutes using 25 volts A.C. The further colours and deposit heights obtained were as follows:

| | | |
|---|---|---|
| 1 minute | clear yellow | 180 nm |
| 3 minutes | clear orange red | 210 nm |
| 5 minutes | clear blue purple | 250 nm |
| 7 minutes | clear bright green | 310 nm |

This is an Example in which anodising beneath the deposits has commenced in the acid colouring baths and then continued in a simple anodising electrolyte, and the normal progression of colours has continued.

EXAMPLE 16

In this Example the sequence of operations was
Steps (a)
(b)
(c)
(d).

The Example indicates the effects of more extensive anodising under the deposits (step d), so as to increase the average height of the outer end of the deposit up to 1 micron above the aluminium/aluminium oxide interface. More complete data for the parameters X, Y and Z are tabulated.

The sample consisted of a high purity aluminium—1% magnesium sheet specimen. It was chemically brightened to produce a smooth surface and then anodised in sulphuric acid as in Example 1. It was then treated in 100 g/l phosphoric acid for 4 minutes at 10 volts A.C. followed by 1 minute at 20 volts D.C. (20° C.). Subsequently, it was coloured for 2.5 minutes at 10.5 volts A.C. in an electrolyte containing:

100 g/l nickel sulphate
5 g/l cupric sulphate
200 g/l magnesium sulphate
pH 5.0
Temperature 20° C.

At this stage the colour was a dark blue.

The sample was then anodised in a 20 g/l sulphosalicylic acid solution at 50 volts A.C. for 2 to 10 minutes, the following coloures being produced:

| | |
|---|---|
| 2 minutes | clear purple |
| 4 minutes | clear magenta |
| 6 minutes | clear green |
| 8 minutes | clear pale magenta |
| 10 minutes | clear pale green |

Anodising beneath the deposits occurred during the sulphosalicyclic acid treatment which was allowed to continue to such an extent that the green produced after 10 minutes was of the fourth cycle of colours. The colours produced by the higher order interference effects are paler because the multiple interference phenomena additively produce a larger proportion of white light.

An electron-optical study of the sample yielded data for X, Y and Z for each of the colours quoted above. (The values in the first row—dark blue—are of Y', Z' and Y'+Z'). The values of X are deposit diameters—it is assumed that these are substantially the same as pore diameters.

TABLE II

| COLOUR | X (nm) | Y (nm) | Z (nm) | Y + Z (nm) |
|---|---|---|---|---|
| Dark blue | 20–40 | 30–40 | 65–95 | 90–110 |
| Clear purple | 20–40 | 240–270 | 65–95 | 290–335 |
| Clear magenta | 20–40 | 335–415 | 65–95 | 420–530 |
| Clear green | 20–40 | 400–550 | 65–95 | 560–630 |
| Clear pale magenta | 20–40 | 545–635 | 65–95 | 635–695 |
| Clear pale green | 20–40 | 830–890 | 65–95 | 900–1000 |

EXAMPLE 17

In this Example the sequence of operations was
Steps (a)
(b)
(c)
(d).

An $AlMg_2Si$ sample was sulphuric acid anodised as in Example 1 and then treated in 100 g/l phosphoric acid at 21° C. for 4 minutes at 10 volts A.C. It was then coloured in a bath containing 50 g/l nickel sulphamate and 150 g/l magnesium sulphate at 18° C. and pH 1.5 (adjusted with $H_2SO_4$) for 1.5 minutes at 20 volts A.C. The colour of the panel was dark purple blue at this stage (deposit height, 80 nm). It was then fixed in a 5 g/l sodium dichromate solution to prevent colour loss.

The sample was then placed in a sulphosalicylic acid solution at a pH of 1.5 (about 5 g/l sulphosalicylic acid) and was then anodised at 25 volts A.C. for times of 1 to 11 minutes. In this case the colour had to be fixed by dipping in sodium dichromate after each step in the sulphosalicylic acid to prevent serious colour loss during the subsequent stages. The colours and deposit heights obtained were as follows:

| | | |
|---|---|---|
| 1 minute | medium blue | 110 nm |
| 3 minutes | clear light blue | 140 nm |
| 5 minutes | clear light green | 160 nm |
| 7 minutes | clear light yellow | 180 nm |
| 9 minutes | clear light orange | 200 nm |
| 11 minutes | clear light purple | 230 nm |

Despite the chromate treatment the colours were somewhat lighter than those obtained in Examples 12 and 13.

EXAMPLE 18

In this Example the sequence of operations was
Steps (a)
(b)
(c)
(d).

An $AlMg_2Si$ sample was anodized in sulphuric acid as in Example 1. It was then treated in 100 g/l phosphoric acid for 4 minutes at 10 volts A.C. followed by 1 minute at 20 volts D.C. (20° C.). Subsequently, it was coloured for 5 minutes at 12.5 volts in an electrolyte containing:

100 g/l nickel sulphamate
40 g/l boric acid
200 g/l magnesium sulphate
pH 5.6
Temperature 20° C.

At this stage the colour was a dark bronze typical of the bronzes produced by the deep deposits of conventional electrolytic colouring processes, and with an estimated average height of the outer end of the deposits above the aluminium/aluminium oxide interface of several hundred nm.

The sample was then anodised in a 20 g/l sulphosalicylic acid solution at 25 volts A.C. for 1 to 10 minutes, the following colours being obtained:

| | | |
|---|---|---|
| 1 minute | yellow bronze | >>200 nm |
| 2 minutes | purple bronze | >200 nm |
| 3 minutes | pale purple blue | 120 nm |
| 4 minutes | clear pale blue | 140 nm |
| 5 minutes | clear pale green | 150 nm |
| 7.5 minutes | clear yellow | 180 nm |
| 10 minutes | clear light purple | 230 nm |

The colours were paler than those of Examples 8 and 17 because in this case colour fixing by immersion in a sodium dichromate solution was omitted.

It is believed that during the first 2 to 3 minutes of the sulphosalicylic acid treatment the depth of the deposits is reduced leaving large shallow deposits in the modified pores, and subsequently, the progression of clear colours is produced due to anodising beneath the deposits.

Electron-optical inspections of products obtained by subjecting high-purity aluminium—1% magnesium alloy sheet to the treatments of certain of the foregoing Examples indicated the following ranges of values for X, Y, Z and Y+Z. The values of X are deposit diameters—it is assumed that these are substantially the same as pore diameters.

TABLE III

| Example | X (nm) | Y (nm) | Z (nm) | Y + Z (nm) |
|---|---|---|---|---|
| 3 (clear orange) | 25–40 | 130–160 | 50–90 | 180–260 |
| 4 (clear purple) | 25–50 | 90–115 | 75–130 | 220–260 |
| 7 (strong clear purple) | 25–40 | 45–80 | 90–160 | 160–240 |
| 9 (clear greenish blue) | 25–40 | 110–140 | 20–55 | 150–160 |
| 14 (clear orange red) | 25–40 | 170–250 | 35–55 | 205–240 |

We claim:

1. An aluminium article having an anodic oxide coating on its surface including a first porous oxide film having a thickness of at least 3 microns, the pores of said film having inorganic pigmentary material deposited therein, the average size of the said deposits at their outer ends, with reference to the aluminium/aluminium oxide interface, being at least 26 nm, the article being coloured by virtue of optical interference, wherein there is present a second oxide film formed between the inorganic pigmentary deposits having a height, and their outer ends being separated from said interface by a distance of from 75 nm to 600 nm, for imparting to said article surface a visually perceptible colour produced by optical interference effects.

2. An article as claimed in claim 1, wherein the average thickness of the second oxide film is at least 15 nm.

3. An article as claimed in claim 1 wherein the second oxide film is partly porous.

4. An article as claimed in claim 1 wherein the separation between the inner ends of the inorganic pigmentary deposits and the aluminium-/aluminium oxide interface is at least 60 nm.

5. An article as claimed in claim 1, wherein the average length of the deposits, in a direction parallel to the pores is from 15 nm to 200 nm.

6. An article as claimed in claim 1, wherein the pores have an average size of at least 30 nm along at least 200 nm of their length, the size of the inner ends, with reference to the aluminium-/aluminium oxide interface, of said pores being substantially greater than the size of the outer ends of said pores.

7. An article as claimed in claim 1, wherein the inorganic pigmentary material is metal-containing material in which the metal is one or more of tin, nickel, cobalt, copper, silver, cadmium, iron, lead, manganese and molybdenum.

8. An article as claimed in claim 7, wherein the metal-containing material is one of Sn—Ni, Cu—Ni, Cu—Co, Cu—Mn, Mn—Ni, Ni—Mo and Mn—Co.

9. A method of treating an aluminium article, which method comprises providing an article having an anodic oxide coating on its surface including a first porous oxide film having a thickness of at least 3 microns, the pores of said film having inorganic pigmentary material deposited therein, the average size of the said deposits at their outer ends, with reference to the aluminium-/aluminium oxide interface, being at least 26 nm, the article being coloured by virtue of optical interference, and forming a second oxide film between the bottoms of the said deposits and the aluminium/aluminium oxide interface, said deposits having a height, and their outer ends being separated from said interface by a distance of from 75 to 600 nm, for imparting to said article surface a visually perceptible colour produced by optical interference effects.

10. A method of forming an aluminium article having an oxide coating coloured by optical interference, which method comprises the steps of (a) forming a porous anodic oxide film at least 3 microns thick on the surface of the article, (b) if the pores have an average cross-section of less than 26 nm, increasing the cross-section of the pores towards their inner ends, with reference to the aluminium/aluminium oxide interface, to an average size of at least 26 nm, (c) forming deposits of inorganic pigmentary material in the thus enlarged regions of the said pores so that the average size of the outer ends, with reference to the aluminium/aluminium oxide interface, of the said deposits is at least 26 nm, (d) effecting further aluminium oxide formation beneath the said deposits so as to increase the distance of the deposits from the aluminium/aluminium oxide interface, said deposits having a height and their outer ends being separated from said interface by a distance of from 75 nm to 600 nm, for imparting to said article surface a visually perceptible colour produced by optical interference effects.

11. A method as claimed in claim 10, wherein step (d) is performed simultaneous with step (c) by depositing the inorganic pigmentary material from an anodising aqueous medium at a pH of from 0.5 to 2 so as to effect deposition of the inorganic pigmentary material at the inner ends of the pores and simultaneous formation of aluminium oxide beneath the said inner ends of the pores.

12. A method as claimed in claim 10, wherein step (d) is performed subsequent to step (c) by subjecting the article resulting from step (c) to electrolytic treatment in a bath containing an anodising acid.

13. A method as claimed in claim 12, wherein the electrolytic treatment of step (d) is performed under alternating current conditions.

14. A method as claimed in claim 10, wherein step (b) is performed by electrolytically treating the article resulting from step (a) in electrolyte having a high dissolving power for aluminium oxide, said treatment being carried out at least in part under alternating current conditions.

15. A method as claimed in claim 9 wherein the inorganic pigmentary deposits are of tin-nickel or copper-nickel.

* * * * *

UNITED STATES PATENT AND TRADEMARK OFFICE

CERTIFICATE OF CORRECTION

PATENT NO. : 4,310,586

DATED : January 12, 1982

INVENTOR(S) : Peter G. Sheasby et al.

It is certified that error appears in the above-identified patent and that said Letters Patent are hereby corrected as shown below:

Col. 2, lines 9 and 10, "employed" should read --employing-- .

Col. 4, line 29, "that if" should read --than if-- .

Col. 5, line 46, "permformance" should read --performance-- .

Col. 14, line 54, "260 A" should read --260 Å-- .

Signed and Sealed this

Ninth Day of November 1982

[SEAL]

Attest:

GERALD J. MOSSINGHOFF

Attesting Officer

Commissioner of Patents and Trademarks